US008966702B1

(12) United States Patent
Green

(10) Patent No.: US 8,966,702 B1
(45) Date of Patent: Mar. 3, 2015

(54) SPONGE CLEANING APPARATUS FOR CUTLERY

(71) Applicant: Daniel Joseph Green, Richmond Hill, GA (US)

(72) Inventor: Daniel Joseph Green, Richmond Hill, GA (US)

( * ) Notice: Subject to any disclaimer, the term of this patent is extended or adjusted under 35 U.S.C. 154(b) by 0 days.

(21) Appl. No.: 14/225,352

(22) Filed: Mar. 25, 2014

(51) Int. Cl.
*A47L 21/04* (2006.01)
*A47L 17/00* (2006.01)
*A47L 13/16* (2006.01)

(52) U.S. Cl.
CPC *A47L 17/00* (2013.01); *A47L 13/16* (2013.01)
USPC ..... 15/218.1; 15/229.11; 15/244.1

(58) Field of Classification Search
USPC ..... 15/218.1, 229.11, 244.1
See application file for complete search history.

(56) References Cited

U.S. PATENT DOCUMENTS

| | | | | | |
|---|---|---|---|---|---|
| 836,189 | A * | 11/1906 | Hutchinson | 15/218.1 |
| 1,219,993 | A * | 3/1917 | Omoto | 15/218.1 |
| 1,349,123 | A * | 8/1920 | Erikson | 15/218.1 |
| 2,148,009 | A * | 2/1939 | Bing | 15/100 |
| 4,374,445 | A * | 2/1983 | Wilson | 15/220.4 |
| 5,009,195 | A * | 4/1991 | Damm | 119/633 |
| 5,918,341 | A * | 7/1999 | Hale | 15/209.1 |
| 5,979,003 | A * | 11/1999 | Billat | 15/104.94 |
| 6,192,543 | B1 * | 2/2001 | Lee | 15/118 |
| 7,307,055 | B2 * | 12/2007 | Cook et al. | 510/438 |
| 7,383,590 | B1 * | 6/2008 | Duncan | 2/158 |
| 2004/0117935 | A1 * | 6/2004 | Cavalheiro | 15/244.1 |
| 2010/0162508 | A1 * | 7/2010 | Olhe et al. | 15/229.11 |

* cited by examiner

*Primary Examiner* — Randall Chin
(74) *Attorney, Agent, or Firm* — Sonya C. Harris; Invention Services

(57) ABSTRACT

A sponge cleaning apparatus for cleaning sharp-edged objects, such as the blades of knives and other cutlery apparatus. The present invention is a sponge cleaning device of an essentially unitary structure having an overall parabolic U shape, and having a protective, armored layer, wherein the protective armored layer has a varying thickness which provides varying rigidity for facilitating a gripping hold on the cutlery while being cleaned. The present sponge apparatus can readily receive the sharp edge of an item of cutlery in a substantially enclosing manner due to the more flexible distal ends, while simultaneously providing safety from any sharp edges of cutlery due to increased rigidity, so as to effectively provide cleaning of said sharp edged surfaces while being frictionally slid in a generally translational motion. The present invention further provides enhanced ergonomic features providing finger guides as well as an array of gripping members for facilitating safety and frictional engagement of the sponge apparatus when in use.

13 Claims, 4 Drawing Sheets

SPONGE CLEANING APPARATUS FOR CUTLERY

FIELD OF INVENTION

The present disclosure relates generally to a sponge device, and more specifically, to an armored sponge device for cleaning cutlery and other sharp edged objects such as blades, knives, and the like.

BACKGROUND

Apparatus for cleaning cutlery and other sharp edged devices are well known in the art and range from gloved devices to complex machinery that not only clean cutlery but also provide means for sharpening the edges of such devices. For example, U.S. Pat. No. 6,192,543 for a Cleaning Mitt Apparatus teaches of a cleaning mitt that is flexible and may be folded during use about center seam and having abrasive portions. U.S. Pat. No. 7,307,055 for Cleaning Implements generally discloses a foldable abrasive cleaning device which may be impregnated with a substance to aid in cleaning. The Multi Purpose Hand Grip of U.S. Pat. No. 7,383,590 teaches of a hand mitt device which may be used to assist with the gripping of an object while protecting the hand. This gripping mitt comprises a reinforcing interior layer which is disclosed as including metal. The Hand Sized, Controlled-Fold, Cleaning Sleeve disclosed in U.S. Pat. No. 5,918,341 shows the general art of a multiple folding abrasive cleaning device. The U.S. Published Patent Application 20100162508 for a Flexible Cleaning Article teaches of a multi-layered, flexible cleaning article which could comprise sponge material and have scouring surfaces.

SUMMARY

This application relates to a sponge cleaning device having a protective, armored layer for cleaning sharp-edged objects, such as the blades of knives and other cutlery apparatus, wherein the protective armored layer has a varying thickness which provides varying rigidity for facilitating a gripping hold on the cutlery while being cleaned. Accordingly, it is an object of the present invention to provide a sponge cleaning device that can be readily receive the sharp edge of an item of cutlery in a substantially enclosing manner, while providing the safety of not getting cut by said sharp edge due to an armored rigid, so as to effectively provide cleaning of said sharp edged surfaces while being frictionally slid in a generally translational motion along the edge.

In accordance with an aspect of the present disclosure, there is disclosed sponge cleaning device that can fit within the hand of a user, and comprising layers including an absorbent and porous spongy layer for receiving and disseminating fluid and/or solid materials such as water and/or cleansing substances.

In accordance with yet another aspect of the present disclosure, there is disclosed a sponge cleaning device that can fit within the hand of a user and comprising an armored layer which serves to protect the hand of the user from the sharp edges during cleaning and further providing a set of finger guards for maintaining secure placement of the sponge within the hand during use.

In accordance with yet another aspect of the present disclosure, there is disclosed a sponge cleaning device that can fit within the hand of a user comprising a layer that is lightweight and having a varying thickness thus providing varying rigidity and semi-flexible portions so as to fold about the sharp edge of a cutlery device in an opening and closing manner to provide frictional cleaning of the sharp edges.

In accordance with yet another aspect of the present disclosure, there is disclosed a sponge cleaning device that can fit within the hand of a user and comprising an armored layer which serves to protect the hand of the user from the sharp edges during cleaning and further providing a set of finger guards on one side of the device, for maintaining secure placement of the sponge within the hand during use, and comprising gripping members on an exterior layer thereof for facilitating safe and secured handling by a user when the sponge apparatus is wet.

In accordance with yet another aspect of the present disclosure, there is disclosed a sponge cleaning device that is sized and dimensioned to fit within the hand of a wearer which will be durable and efficient in use, and simple to manufacture, and placed upon the market at a reasonable cost.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

BRIEF DESCRIPTION OF THE DRAWINGS

Embodiments of the present disclosure are described herein with reference to the drawings, in which.

The novel features which are characteristic of the invention, as to organization and method of use, together with further objects and advantages thereof, will be better understood from the following disclosure considered in connection with the accompanying drawings in which one or more preferred embodiments of the invention are illustrated by way of example. It is to be expressly understood, however, that the drawings are for the purpose of illustration and description only and are not intended as a definition of the limits of the invention.

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has". The term set has the meaning of one or more of said element. Furthermore, any use of the term "or" as used herein is generally intended to mean "and/or" unless otherwise indicated. Combinations of components or steps will also be considered as being noted, where terminology is foreseen as rendering the ability to separate or combine is unclear.

DETAILED DESCRIPTION

Figure 1:
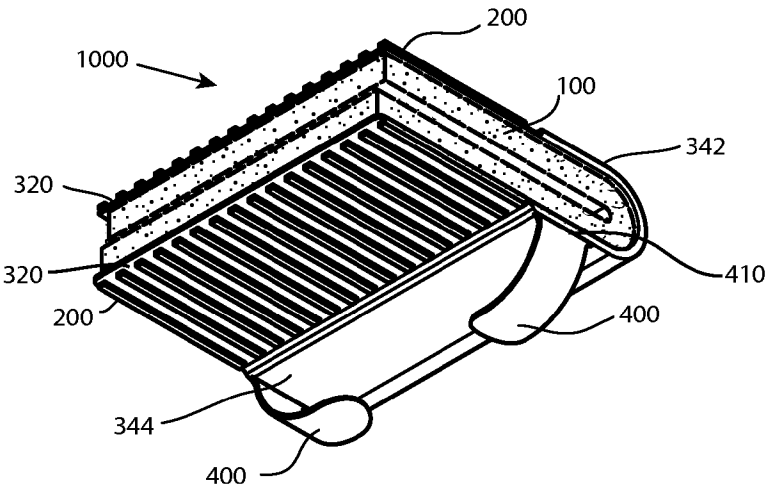
FIG. 1 is a perspective diagram of the sponge cleaning apparatus showing a first side in accordance with an embodiment of the present invention.
Figure 2:
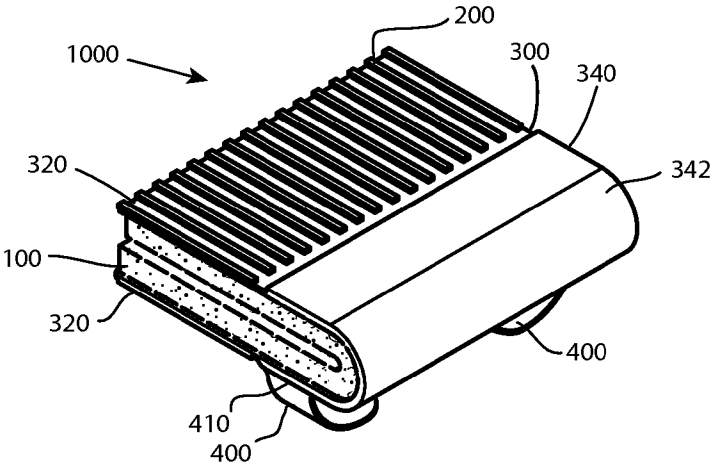
FIG. 2 is a perspective diagram of the sponge cleaning apparatus showing a second side in accordance with an embodiment of the present invention.

Referring now to the drawings, FIGS. 1 and 2 illustrate perspective views of a first and second side of the sponge cleaning apparatus (SPA) 1000, respectively. The SPA 1000 provides frictional, sponge-like cleaning of sharp edged objects and is comprised of a plurality of layers, which essentially form a unitary structure having an overall parabolic U shape, described in further mathematical detail below. The SPA 1000 is comprised of a unitary armoring layer (UAL) 300 having a set of finger guides 400 extending there from, a sponge layer 100 bonded to the interior thereof, and an array of gripping members 200 on the exterior of said UAL 300. The SPA 1000 may be used for the cleaning of soiled cutlery devices and can be beneficial in any environment where sharp edged devices become dirty with use and need cleaning, ranging from kitchen/cooking environments to construction to surgery.

Figure 3:
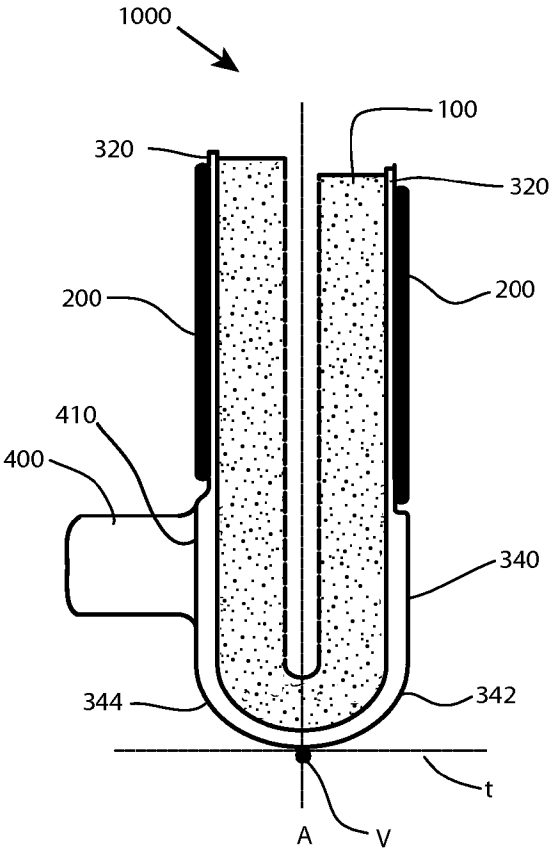
FIG. 3 is an elevational diagram showing the side view of the sponge cleaning apparatus, according to certain embodiments of the present disclosure.
Figure 7:
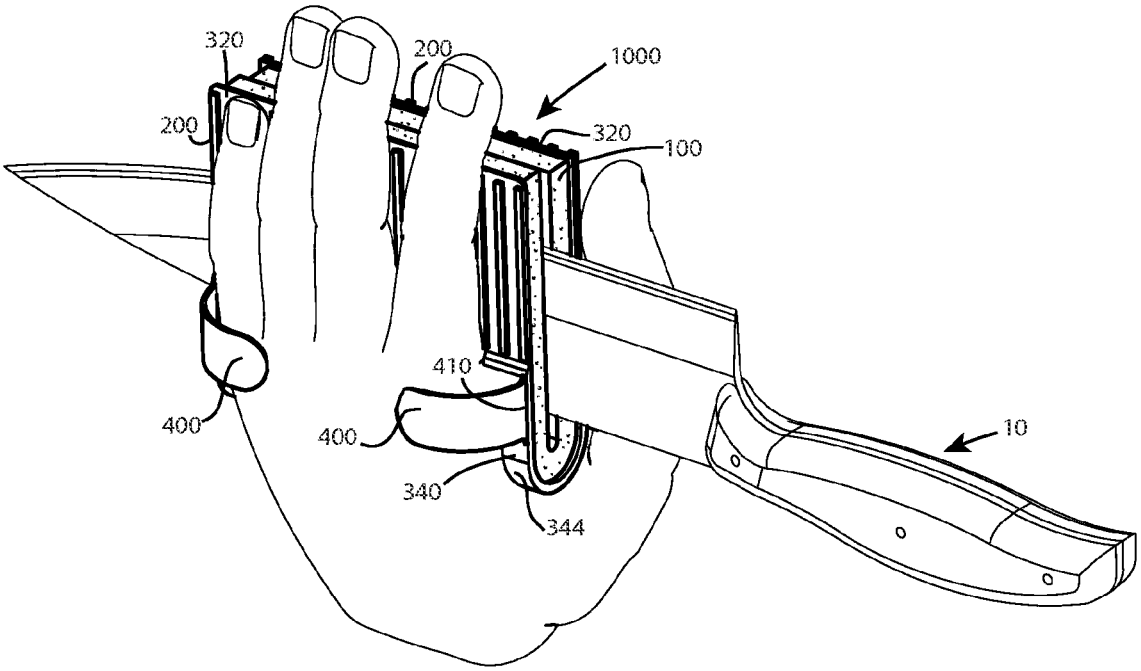
FIG. 7 is an illustration of the sponge cleaning apparatus in use according to certain embodiments of the present disclosure.

As best seen in FIG. 3, the UAL 300 is dimensioned and configured into a U-shape bend forming a parabola wherein the bottom lower end forms the semicircular curve of the U and the upper distal ends 320 forming opposing arms of the U. The semicircular curving lower proximal end 340 is formed by the convergent proximal portion (CPP) 344 (shown on the left side of the device in FIG. 2), and the divergent proximal portion (DPP) 342 (shown of the right side of the device in FIG. 2). The SPA 1000 is substantially symmetrical about a longitudinal axis of symmetry A and having the vertex V (at the bottom most portion of the parabola of the UAL 300) which is defined mathematically by the centermost point wherein a tangent line t is directly perpendicular to the longitudinal axis of symmetry A. The upper distal ends 320 thus form the opposing legs of the U. In as much as the sponge layer 100 is bonded to the interior of the U shaped UAL 300, the sponge layer also is configured into a substantially U shape having opposing facing sides for providing contact cleaning of the sharp edges of cutlery 10 when placed there between (as seen in FIG. 7). The UAL 300 can be formed of any material that is waterproof, and having substantial rigidity in nature, while having some flexibility to the material as well (such as a soft metal, e.g., aluminum) or a plastic material, or combinations thereof (i.e., plastic coated alloys) which is capable of bending during assembly.

As can be best seen in FIGS. 1 and 2, the SPA 1000 has an array of gripping members 200 bonded to, and located on, the upper distal ends 320. The gripping members 200 provide a series of raised friction surface areas for engaging with the fingers and thumb of a user (note FIG. 7) and may be comprised of a semi-rigid plastic or rubberized elastomeric friction reinforcing material well known in the art. The gripping members 200 provide frictional engagement means that enhance the gripping effect while the hand of the user in about the SPA 1000, and may be comprised of ridges, notches, grooves, combinations thereof, or other suitable demarcations provided on the upper distal ends 320.

Figure 4:
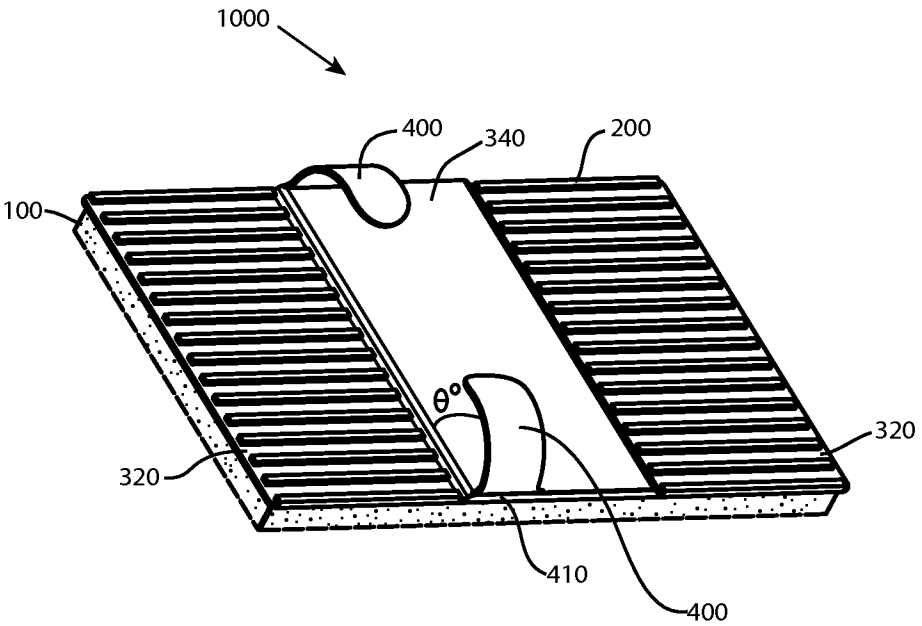
FIG. 4 is a perspective view of the sponge cleaning apparatus illustrating the apparatus before the U bend, according to certain embodiments of the present disclosure.
Figure 6:
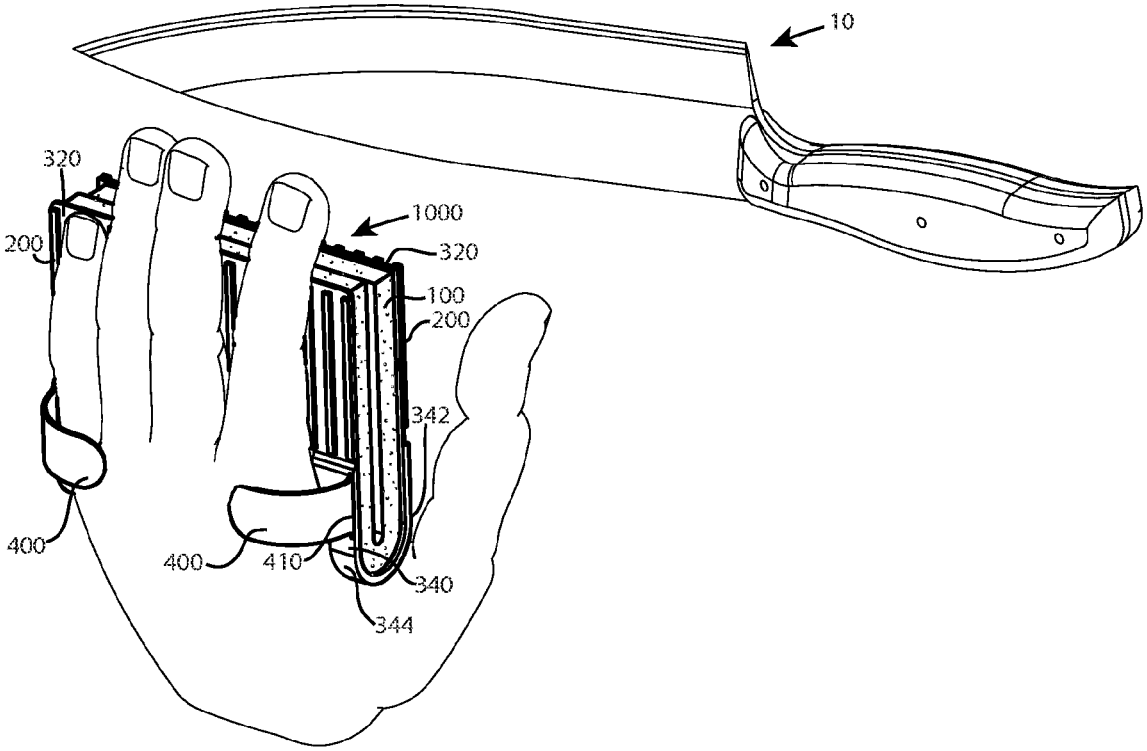
FIG. 6 is an illustration of the sponge cleaning apparatus in preparation for use according to certain embodiments of the present disclosure.

The set of finger guides 400 extend laterally from and above the lower proximal end 340 of the UAL 300, and in an embodiment of the present invention as shown in FIG. 4, they may be configured in a curved manner having an angle Ø (theta) defining the rate of curvature, and which facilitates ergonomic placement about the hand and fingers. The rate of curvature, theta, may be in a range of approximately 30-60 degrees, such that the finger guards extend about the fingers and hands of the user in an ergonomic fashion. The lower proximal end 340 (comprising both the CPP 344 and the DPP 342) is the thickest section of the UAL 300. Since the UAL 300 is dimensioned with varying thickness, i.e., wherein the CPP 344 and DPP 342 are thinner and the lower proximal end 340 is thickest, this allows for a more rigid, inflexible base portion of the SPA 1000 and more flexible distal ends, all of which enhances ergonomic placement and facilitates sufficient gripping and some manipulation of the upper distal ends 320 when cleaning cutlery 10, as can be gleaned by FIGS. 6 and 7. In another embodiment, the finger guides 400 may also take the form of finger inserts to facilitate ergonomic fitting about the fingers of the user about the distal ends 320 and sides of the SPA 1000.

In one embodiment, the set of finger guards 400 may be formed of the same material as the UAL 300 and extend laterally from and above the lower proximal end 340 as a contiguous curved extension. However, one of ordinary skill in the art would conceive of the fact that the finger guards 400 could be made separately and bonded to the lower proximal end 340. The finger guards 400 are configured such that they extend from the thicker portion of the UAL 300, as this provides for more structural integrity at the juncture 410 of the finger guards 400 and the lower proximal end 340, as illustrated best in FIGS. 4 and 5. This reinforces structural rigidity of the SPA 1000 while in use, as well as more importantly provides safety from any sharp edges of the blades or cutlery elements being cleaned when inserted within the SPA 1000.

Figure 5:
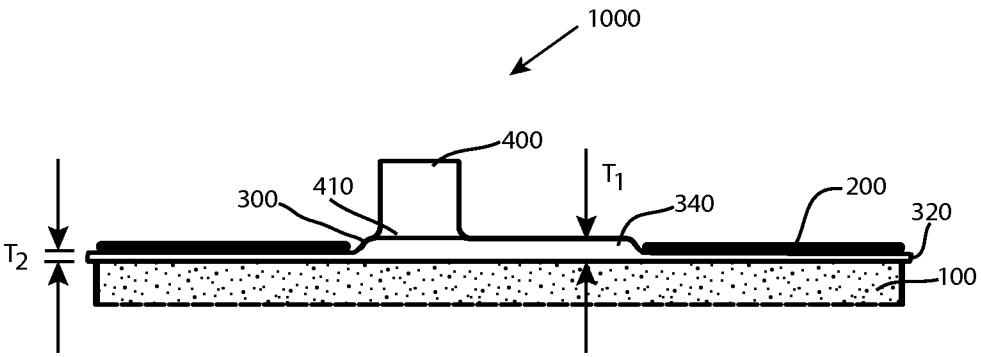
FIG. 5 is a side view of the sponge cleaning apparatus before the U bend illustrating layers and relative thicknesses thereof according to certain embodiments of the present disclosure.

FIGS. 4 and 5 illustrate the SPA 1000 prior to the manufacturing step of configuring the apparatus into the U shape bend. Those of ordinary skill in the are would recognize that the UAL 300 may be formed into the U shape employing necessary manufacturing processes such as molding, curing, (i.e., thermal, chemical, thermo chemical shaping) or via mechanical bending and shaping, or via processes that may involve combinations thereof depending on the material composition of the UAL 300. However, the material hardness, firmness, rigidity and flexibility are careful design considerations—thereby attaining the sufficient durometer strength of the UAL 300. The UAL 300 may be comprised of hard rubbers, semi-rigid and hard plastics, and may include the Shore A and the Shore D scale.

FIG. 5 best illustrates the varying thicknesses of the UAL 300. The upper distal ends 320 (shown on either side of the pre-bent SPA 1000 of FIGS. 4 and 5) have a more narrow thickness $T_2$ (and thus more flexible), than the thickness $T_1$ (and thus more rigid/less flexible) of the lower proximal end 340. In one embodiment, preferred dimensions of the UAL 300 are such that $T_1>T_2$, and in some embodiments $T_1\approx 2T_2$. Such a ratio between the thicknesses of the two sections ensures a rigid, armored protection provided by lower proximal end 340, and less rigid and more flexible upper distal ends 320; wherein both of these characteristics combined provide a criticality to the properties of the rigid and semi-rigid flexibilities of lower proximal end 340 to flexible upper distal ends 320, respectively. This rigidity of lower proximal end 340 prevents flexing and facilitates armoring against sharp edges of cutlery 10. The semi-rigidity of upper distal ends 320 provides flexibility when pinching the sides of the SPA 1000 against the sides of cutlery 10 during cleaning.

The sponge layer 100 is bonded to the interior side of the UAL 300, and the array of gripping members 200 are bonded to the exterior side of the UAL 300, such that they are located on the proximal ends CPP 344 and DPP 342. The bonding of each of the sponge layer 100, gripping members 200, and UAL 300 may be by way of suitable bonding methods known to artisans having ordinary skill in the art, such as chemical, thermal, and or mechanical bonding means. Such bonding means including, but not limited to adhesive bonding agents, heat sealing processes, and mechanical attachment methods. These include any variety of bonding solutions, or thermal bonding processes, or mechanical attachment means, or any combinations thereof.

The interior sponge layer 100 may also be formed of one or more layers of sponge materials, including abrasive scouring materials, which may form a contiguous cleaning surface area for contact with the sharp edged of cutlery 10 and for removing any hard to remove debris on the cutting edge's surface, e.g., food on a knife's cutting surface. The sponge layer 100 may be comprised of any suitable sponge-like or ordinary sponge materials well known in the art, which, in their broadest aspects, might be considered to be open-celled foams. For example, both natural sponges and artificial cellulosic sponges provide fluid holding and dispensing properties, which are useful during cleaning Many common sponge materials can have non-uniform cell sizes, which provide fluid retention characteristics by the sponge, and in some cases may provide both scouring and absorbent characteristics. And, while common sponge materials can imbibe substantial quantities of aqueous fluids, they can also release the imbibed fluids with very little pressure, and thus aiding in the cleaning process, especially when cleansing agents are employed. Cleansing agents may be impregnated into the sponge layer 100 during use when cleaning a knife or blade, or in a prior a manufacturing phase of the sponge-like material. Suitable cleaning agents include detergents, polishing solutions, or anti-microbial solutions that may assist in the cleaning and/or polishing of the cutlery element. In one embodiment, a preferred dimension measurement of the varying thickness of the sponge layer 100 may be in the range of approximately 2.5 mm to 5.0 mm.

It is to be appreciated that one or more of the elements depicted in the drawings/figures can also be implemented in a more separated or integrated manner, or even removed or rendered as inoperable in certain cases, as is useful in accordance with a particular application. Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth.

Therefore, many modifications may be made to adapt a particular situation or material to the essential scope and spirit of the present invention. It is intended that the invention not be limited to the particular terms used and/or to the particular embodiment disclosed as the best mode contemplated for carrying out this invention, but that the invention will include any and all embodiments and equivalents falling within the scope of the instant disclosure. For example, the UAL 300 and sponge 100 may be comprised of a unitary part, however it is understood that as a manufacturing and/or design consideration that they may be comprised of one or more sections to make the whole. Moreover, the sponge layer 100 may be impregnated with abrasive materials in one or more sections providing partial scouring areas of the sponge surface. The set of finger guards 400 may comprise one or more curved guards to guide the hand and fingers of the user, or may be one continuous finger guard 400 extending to either side of the lower proximal end 340. In some embodiments, the array of gripping members may extend on and about the entire exterior side of the UAL 300.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

What is claimed is:

1. A sponge apparatus for cleaning cutlery and sharp edged objects comprising:

an exterior armoring layer having a substantially U-shaped configuration for receiving a sharp edge there between, said exterior armoring layer having varying thicknesses along the length thereof, and wherein said U-shaped configuration of the exterior armoring layer is defined by a proximal portion having a trough portion and a distal portion comprised of two facing opposing distal ends, wherein said trough portion is defined by a convergent portion on a first lateral side, a centrally located vertex, and divergent portion on a second lateral side forming the U bend, and said opposing distal ends extending longitudinally from said convergence portion and said divergence portion with the vertex being substantially the central point of said U bend, and wherein said opposing distal ends are located on opposite sides of the vertex and extend laterally and parallel to a longitudinal axis extending through the vertex; and an interior sponge layer comprised of an absorbent, porous material, and said interior sponge layer is bonded to said exterior armoring layer such that said sponge layer is also configured into a substantially U-shape having opposing facing sides for providing contact cleaning of sharp edges, when placed there between; and a set of finger guards extending laterally from the sides of the exterior armoring layer; and an array of gripping members located on the outer, exterior side of each of said distal opposing ends of said exterior armoring layer.

2. The sponge apparatus of claim 1 wherein:

said finger guards extend from first and second sides of said convergent portion, and said set of finger guards having a curved configuration for ergonomically fitting about the finger and hands of a user.

3. The sponge apparatus of claim 2 wherein:

said array of gripping members are bonded to the exterior armoring layer, and wherein one of said array of gripping members extends the length from the convergent portion to one of said opposing distal end, and another of said array of gripping members extends the length from the divergent portion to a second of said opposing distal end, and wherein said array of gripping members comprising a textured friction layer for providing gripping nonslip friction for the fingers and thumb of a user.

4. The sponge apparatus of claim 3 wherein:

said trough portion is comprised of a rigid, inflexible material and said opposing distal ends are comprised of a semi-rigid, semi-flexible material.

5. The sponge apparatus of claim 4 wherein:

said trough portion has a thickness greater than the thickness of said opposing distal ends.

6. The sponge apparatus of claim 5 wherein:

the trough portion is configured and dimensioned such that it has a thickness approximately twice as thick as each of the opposing distal ends.

7. The sponge apparatus of claim 5 wherein:

said exterior armoring layer is comprised of hard plastics.

8. The sponge apparatus of claim 5 wherein:

said exterior armoring layer is comprised of semi-flexible metals.

9. The sponge apparatus of claim 5 wherein:

the opposing distal ends have substantially the same length.

10. The sponge apparatus of claim 5 wherein:

the opposing distal ends have dissimilar lengths.

11. The sponge apparatus of claim 1 wherein:

the exterior armoring layer is formed on a single contiguous material having varying thicknesses.

12. The sponge apparatus of claim 2 wherein:

said curved configuration of said set of finger guards has an angle theta having an approximate range between 30 to 60 degrees.

13. The sponge apparatus of claim 3 wherein:

said array of gripping members is comprised of rubberized materials.

* * * * *